US005186116A

United States Patent [19]

Jimenez et al.

[11] Patent Number: 5,186,116

[45] Date of Patent: Feb. 16, 1993

[54] SEWING MACHINE

[75] Inventors: Antonio Jimenez, Meyrin, Switzerland; Patrice Deplante, Annemasse, France

[73] Assignee: Mefina S.A., Switzerland

[21] Appl. No.: 798,916

[22] Filed: Nov. 29, 1991

[30] Foreign Application Priority Data

Nov. 29, 1990 [CH] Switzerland ..... 3780/90

[51] Int. Cl.[5] ..... D05B 27/02; D05B 27/22

[52] U.S. Cl. ..... 112/323; 112/315

[58] Field of Search ..... 112/323, 314, 315, 316, 112/317

[56] References Cited

U.S. PATENT DOCUMENTS

| | | | |
|---|---|---|---|
| 2,218,287 | 10/1940 | Vesconte | 112/316 |
| 2,711,145 | 6/1955 | Pagni | 112/316 |
| 4,095,540 | 6/1978 | Kaltenbach et al. | 112/315 |
| 4,444,142 | 4/1984 | Meier | 112/315 |
| 4,501,213 | 2/1985 | Meier | 112/316 |
| 4,584,955 | 4/1986 | Sano | 112/315 |
| 4,638,752 | 1/1987 | Hartwig | 112/315 X |
| 4,756,263 | 7/1988 | Sano | 112/315 |
| 4,895,089 | 1/1990 | Adams . | |
| 5,018,467 | 5/1991 | Jimenez | 112/315 |

FOREIGN PATENT DOCUMENTS

| | | |
|---|---|---|
| 0374090 | 6/1990 | European Pat. Off. . |
| 3121266 | 1/1983 | Fed. Rep. of Germany . |
| 1401129 | 6/1964 | France . |
| 1370571 | 10/1974 | United Kingdom . |
| 2038380 | 7/1980 | United Kingdom . |

*Primary Examiner*—Andrew M. Falik
*Assistant Examiner*—Paul C. Lewis
*Attorney, Agent, or Firm*—Cushman, Darby & Cushman

[57] ABSTRACT

The device for adjusting the amplitude and direction of the feeding of the material to be sewn includes a movable element (15) provided with a set of teeth (17) for feeding. This movable element includes a slideway formed of two tracks (20*a*, 20*b*) in the form of arcs of concentric circles, one of which is generated by a cone and the other by a cylinder, both rolling on the trajectory of a shaft (12) providing a link between two levers of the drive mechanism. The two tracks (20*a*, 20*b*) of the slideway are formed by a profiled metal foil, attached to the movable element (15).

3 Claims, 2 Drawing Sheets

SEWING MACHINE

The present invention relates to a sewing machine including a drive mechanism for feeding material to be sewn, associated with a device for adjusting the amplitude and direction of feeding of the fabric, this mechanism including a drive shaft and a fabric transporting device two opposite ends of which are connected kinematically to this drive shaft by two connecting rod and lever transmissions, one of which defines a first displacement trajectory in a direction substantially parallel to a support plane of the fabric, while the other defines a second displacement trajectory in a direction substantially perpendicular to this plane, said adjusting device including a slideway in the form of an arc of a circle centered on a trajectory described by a link between two connecting rods of said transport mechanism, this slideway being mounted pivotably about a shaft passing through the center of this trajectory, and feeler means that are solid with said shaft, in engagement with this slideway.

A sewing machine of this kind is described in European Patent Document A1 0 374 090. In this sewing machine, the slideway is made at the end of a metal cylinder, the cylindrical face of which engages a rolling bearing to assure pivoting without play, which guarantees the precision of the angular adjustment of the slideway. This provision gives quite satisfactory results from the standpoint of precision, but has the disadvantage of being quite expensive, both in terms of machining the slideway, which must be a high-precision part, and in terms of the pivoting by rolling.

German Patent C1 3121266 has already proposed a device for adjusting the amplitude and/or direction of fabric feeding of this type, in which the slide guideway and/or the slide block are of plastic material and have divergent pairs of sliding surfaces. To facilitate the sliding of the slide block in the slide guideway, the plastic material selected has a low coefficient of friction and to this end may be made of PTFE, with silicone or graphite powder added to lower the coefficient of friction. Nevertheless, the fact remains that friction exists, and that it can sooner or later cause wear. Moreover, because the active surfaces of the sliding guideway and/or of the slide block are of plastic material, a long service life of the device cannot be guaranteed.

The object of the present invention is to overcome the above disadvantages, at least partially.

To this end, the subject of the present invention is a sewing machine as defined by claim 1.

Taking into account the relatively complex shape of the slideway, it is simpler to form it by drawing a metal foil rather than by machining a solid block. Moreover, the precision and reproducibility are assured with greater reliability and at less expense.

Further advantages will become apparent in the light of the ensuing description and the accompanying drawing, which schematically shows an exemplary embodiment of of the sewing machine that is the subject of the present invention.

Since the principle of the adjustment of the amplitude and direction of fabric feeding is identical to what is described in detail in the aforementioned European Patent Document A1 0 374 090, this principle will not be explained here again unless it is indispensable to comprehending the present invention, and the reader may refer to the aforementioned document for details relating to this principle.

Figure 1:
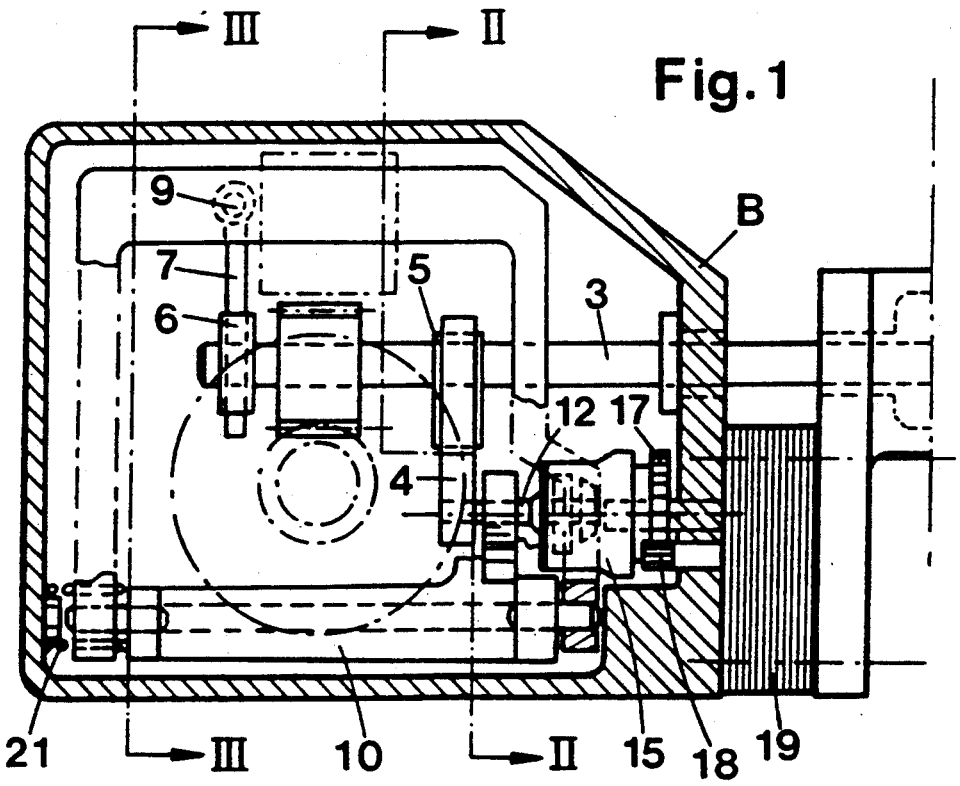
FIG. 1 is a sectional view taken along the line I—I of FIGS. 2 and 3.
Figure 2:
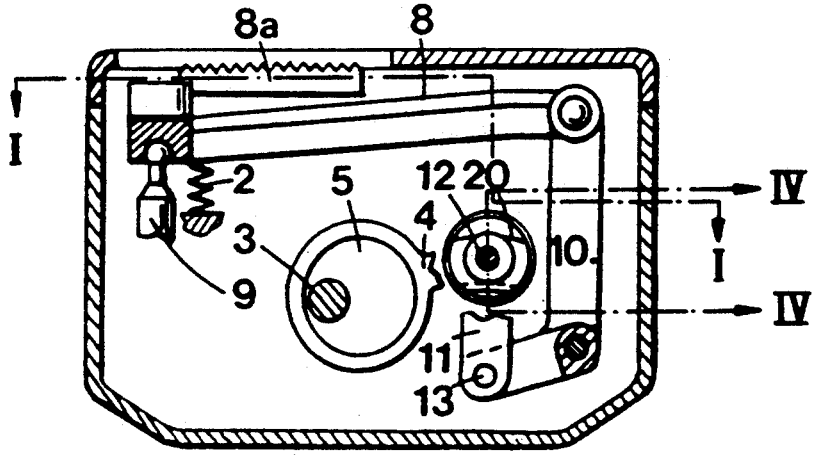
FIG. 2 is a sectional view taken along the line II—II of FIG. 1.
Figure 3:
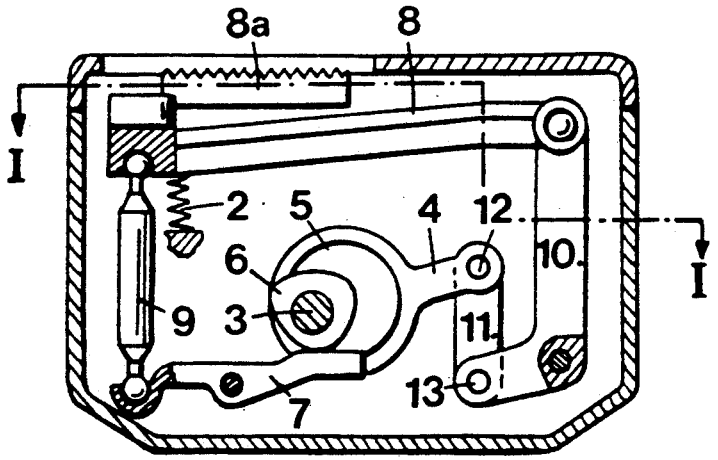
FIG. 3 is a sectional view taken along the line III—III of FIG. 1.

The fabric transporting mechanism and its adjusting device are shown in FIGS. 1-3. This mechanism (see FIG. 3) includes a drive shaft 3 that is solid with a connecting rod 4, one end of which is connected pivotably about an eccentric 5 that describes a circular trajectory around the axis of this drive shaft 3. This shaft 3 also includes a cam 6 against which an arm of a lever 7 presses, the other arm of the lever being connected to one end of a fabric transporting device 8 by a connecting rod 9. A return spring 2 tends to keep the lever 7 in contact with the cam 6.

The other end of this transporting device 8 is pivotably connected to one arm of a lever 10, the other arm of which is connected to the connecting rod 4 by a rocker bar 11.

Figure 4:
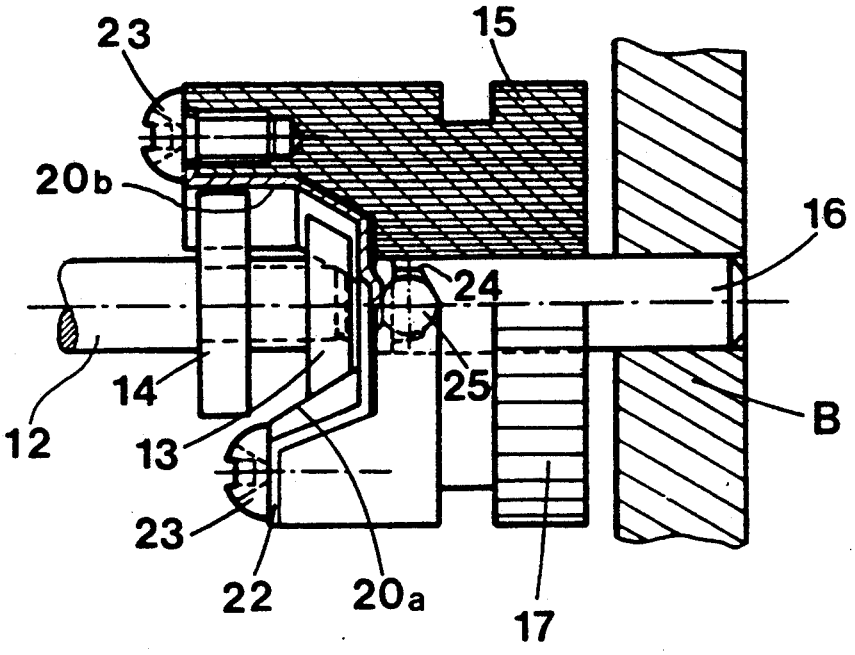
FIG. 4 is an enlarged sectional view taken along the line IV—IV of FIG. 2.

As shown in FIG. 4, the shaft 12 carries two rollers 13 and 14, one of which, 13, is frustoconical and engages a slideway 20 (FIG. 2) made in a movable element 15 pierced axially and mounted pivotably on a pivot 16 fixed to the frame B carrying the transport mechanism. This movable element 15, which serves to adjust the amplitude and direction of the drive of the transporter 8*a*, carries a set of teeth 17 intended to engage a pinion 18 that is solid with the shaft of a stepping motor 19 and is intended to orient the slideway 20 about a central point of the trajectory of the shaft 12, displaced in an alternating movement by the connecting rod 4. A spring 21, disposed between the frame B and the lever 10, presses this lever, and consequently the shaft 12 and the rollers 13 and 14 that it carries, axially in the direction of the movable element 15.

Turning to FIGS. 2 and 4 in order to study the slideway 20 and the rollers 13 and 14 in greater detail, it can be seen that this slideway is formed of two tracks in the shape of arcs of concentric circles 20*a* and 2*b*, one of which, 20*a*, is generated by a cone rolling on the trajectory of the shaft 12, while the other, 2*b*, is generated by a cylinder rolling on this same trajectory. The radius and conicity of the roller 13 relative to its pivot axis are identical to the radius and conicity of the track 20*a* relative to the pivot axis of the movable element 15, so that the two axes are coaxial when the roller 13 is at the center of the track 20*a*, as shown in FIG. 4. Consequently the radius of the roller 14 is defined by the distance between the center of the shaft 12 and the track 2*b*, the roller 13 pressing against the track 20*a*. To prevent the roller 14 from becoming wedged in, in the case where the pivot axes of the movable element 15 on the one hand and of the rollers 13, 14 on the other are not perfectly parallel, the surface of the roller 14 generated by revolution is slightly convex, as shown in FIG. 4.

The tracks 20*a* and 20*b* are drawn in a drawn steel foil 22, attached to a mold of complementary shape that the end of the integrally molded movable element 15 has, and held by screws 23.

The end of the pivot 16 engaging the axial bore of the movable element 15 has an axial recess 24 with a conical bottom, centered on the pivot shaft 16. This recess 24 receives a ball 25, a dome of which extends past the end of the pivot 16 and serves as a stop surface against which the bottom of the drawn steel foil 22 is pressed by way of the spring 21 (FIG. 1), the lever 10 of the link 11, the shaft 12, and the roller 13.

We claim:

1. A sewing machine comprising a cloth transport mechanism and an adjusting device of adjusting cloth transport of said mechanism in amplitude and direction, the cloth transport mechanism comprising a drive shaft and a cloth transport member, the cloth transport member having two opposite ends, each of which is connected kinematically to the drive shaft by a respective connecting rod and lever mechanism, one of the connecting rod and lever mechanisms defining a first displacement trajectory in a direction substantially parallel to a support plane for the cloth while the other of the connecting rod and lever mechanisms defines a second displacement trajectory in a direction substantially perpendicular to said support plane, the adjusting device comprising a slideway having two tracks in the form of arcs of concentric circles centered on a trajectory described by a pivoting axis of a pivotal connecting between two connecting rods of one of said connecting rod and lever mechanisms, and said slideway being mounted pivotingly about an axis parallel to aid pivotal axis and passing through the center of said trajectory described by said pivotal connection, wherein said slideway is formed by a profiled metal foil attached to a device mounted pivotally about said shaft.

2. The sewing machine of claim 4, wherein he pivotally mounted slideway is of a plastic material and has an axial opening of circular-cylindrical cross section engaging an end of the axis parallel to said pivot axis and rigidly connected with a frame of the sewing machine, the end of said axis axially abutting the back side of the prifled metal foillo, at least one of the abutting surfaces having spherical shape.

3. The sewing machine of claim 2, wherein one of said abutting surfaces is constituted by a ball placed in a recess made of one the end of said axis.

* * * * *